US008859478B2

(12) United States Patent
Rochon et al.

(10) Patent No.: US 8,859,478 B2
(45) Date of Patent: Oct. 14, 2014

(54) CLEANING COMPOSITION/SOLUTIONS AND USE THEREOF

(75) Inventors: Michael Rochon, Mansfield (CA); Michael Mikoluk, Peteborough (CA); Asquith Williams, Bowmanville (CA)

(73) Assignee: Process Cleaning Solutions Ltd., Peterborough, Ontario (CA)

( * ) Notice: Subject to any disclaimer, the term of this patent is extended or adjusted under 35 U.S.C. 154(b) by 140 days.

(21) Appl. No.: 13/416,893

(22) Filed: Mar. 9, 2012

(65) Prior Publication Data

US 2013/0233346 A1 Sep. 12, 2013

(51) Int. Cl.

| | |
|---|---|
| ***C11D 7/00*** | (2006.01) |
| ***C11D 3/04*** | (2006.01) |
| *C11D 3/48* | (2006.01) |

(52) U.S. Cl.
CPC . *C11D 3/042* (2013.01); *C11D 3/48* (2013.01)
USPC ..... 510/218; 510/488

(58) Field of Classification Search
CPC ..... C11D 3/042; C11D 3/2086; C11D 3/48
USPC ..... 510/218, 488
See application file for complete search history.

(56) References Cited

U.S. PATENT DOCUMENTS

| | | | | |
|---|---|---|---|---|
| 4,883,679 | A * | 11/1989 | Sewon | 426/532 |
| 4,986,990 | A * | 1/1991 | Davidson et al. | 424/665 |
| 6,190,675 | B1 * | 2/2001 | Beerse et al. | 424/401 |
| 6,221,823 | B1 * | 4/2001 | Crisanti et al. | 510/238 |
| 6,663,902 | B1 * | 12/2003 | Hei et al. | 424/661 |
| 6,936,579 | B2 * | 8/2005 | Urban | 510/412 |
| 7,718,595 | B2 * | 5/2010 | Murphy et al. | 510/424 |
| 2008/0015134 | A1 * | 1/2008 | Ahmed et al. | 510/234 |
| 2011/0028373 | A1 * | 2/2011 | Fossum et al. | 510/236 |
| 2011/0152157 | A1 * | 6/2011 | Woo et al. | 510/236 |
| 2011/0262504 | A1 * | 10/2011 | Deleersnyder et al. | 424/401 |
| 2012/0082629 | A1 * | 4/2012 | Turk et al. | 424/54 |
| 2012/0321681 | A1 * | 12/2012 | Gonzales et al. | 424/401 |

FOREIGN PATENT DOCUMENTS

| | | | |
|---|---|---|---|
| CN | 101019571 B | * | 1/2011 |
| KR | 20010063666 A | * | 7/2001 |

* cited by examiner

*Primary Examiner* — Gregory Webb
(74) *Attorney, Agent, or Firm* — F. Brent Nix; Johnson, Marcou & Isaacs, LLC

(57) ABSTRACT

A a non-disinfectant formulated solution and a process for removal of soil and disease causing microorganisms from a surface/substrate. The process including contacting the surface/substrate with the formulated solution and applying a dry cloth to the surface/substrate thereafter. In one formulated cleaning solution there is at least two organic acids and sodium chloride mixed thereinto.

24 Claims, No Drawings

CLEANING COMPOSITION/SOLUTIONS AND USE THEREOF

TECHNICAL FIELD

The present invention provides for an efficient process of physical removal of organic soils including disease causing bacteria and bacterial spores to levels claimed by chemical existing disinfectants.

In particular, applying the formulated solution to a target site dislodges soil and micro-organisms associated therewith from a surface/substrate/substrate by increasing the surface/substrate tension and friction of the target area for sequestering the pathogen laden soil; and applying a dry cloth to the same surface/substrate/substrate thereafter for removal.

BACKGROUND OF THE INVENTION

The present invention relates generally to non-disinfectant cleaning products, and more particularly, to cleaning products having only naturally derived components without the need for surfactants. The formulated cleaning composition of the present invention exhibits no skin irritation unlike existing synthetically derived disinfecting/cleaning products, though somewhat environmentally degradable. These disinfecting/cleaning products are suspected of inducing negative biologic responses in the environment. For example, the rates of hospital acquired infections in health care facilities today are higher than they have been in decades.

The reliance on currently available disinfecting products to reduce pathogens from environmental surface/substrates to the levels claimed on labels has not been achieved in practice. Natural organic cleaners can be formulated into disinfectants but only with very low efficacy. As a result, the disease causing microorganisms are becoming more resistant to the point that the use of highly toxic disinfectants is being deployed in an attempt to clean hospital environments which in turn provides increasingly hazardous conditions for staff and patients alike. In particular, the dependence on the use and application of disinfectants to surface/substrates not only encourages surface/substrates to be left wet but as a consequence allows for ongoing microbial survival and growth. A typical example of the latter problem can be found in washroom soils that contain fecal contamination which spread disease through the fecal oral route. Touching soiled surface/substrates allows for the transfer of such contamination to additional surface/substrates. Today's washroom soils may include very resistant disease causing microorganisms including *Clostridium difficile* a spore forming bacteria spread by fecal contamination that only high concentrations of bleach and other hazardous sporicidal disinfectants are partly effective on. *C. difficile* like methicillin-resistant *Staphylococcus aureus* (MRSA) is now commonly acquired in the community and is no longer just an issue in hospitals.

Existing disinfecting/cleaning practises have many drawbacks, for example, *C. difficile* can be spread from contaminated cleaning cloths, therefore, preventing the spread of disease causing microorganisms from cleaning cloths is a serious concern and requires a great deal of validation of the cleaning methods currently used. Accordingly, There is a need in the art to find an alternative formulated cleaning composition and method of use thereof to substantially reduce disease causing bacteria of all kinds in commercial and private areas including health care facilities, institutions, schools, at the office, at home and in food processing and manufacturing plants. Moreover, there is a need in the art for a new process and a new non-disinfectant cleaning formulation having natural components that exhibit excellent low skin toxicity, high clearance of microbiological pathogens accompanied with a high environmental degradability or biodegradability.

The present invention removes itself from the current understanding and practice of how best to clean areas in need thereof and accordingly provides a better alternative both in the type of formulated cleaning composition and it's use.

SUMMARY OF THE INVENTION

An aspect of the present invention provides for a non-disinfectant formulated solution and a process for removal of soil and disease causing microorganisms from a surface/substrate including the steps of contacting the surface/substrate with the solution and applying a dry cloth to the surface/substrate thereafter.

Another aspect of the present invention provides for a cleaning composition including effective amounts of at least two organic acids; sodium chloride; and a carrier having the at least two organic acids and sodium chloride mixed thereinto, the amounts of the at least two organic acids and sodium chloride being sufficient to result in the cleaning composition having commercial acceptable cleaning properties for a surface/substrate/substrate. The composition includes from about zero point zero eight (0.08%) to about one point six (1.6%) by weight of sodium chloride.

In a preferred embodiment the composition of the present invention provides for about ten percent (10%) by weight of the at least two organic acids, mixed into a diluent carrier. The at least two organic acids are selected from the group consisting of carboxylic acid, dicarboxylic acid and tricarboxylic acid. In a further embodiment, the tricarboxylic acid is an anhydrous form of citric acid in combination with an alpha hydroxy acid. Preferably, the alpha hydroxy acid is lactic acid. Preferably, the at least two organic acids are on average about one point five percent (1.5%) citric acid, and about two point six percent (2.6%) lactic acid, by weight, and the diluent is about on average ninety five percent (95.0%) deionized water.

In another embodiment the composition in a concentrate form comprises about two point eight percent (2.8%) by weight of citric acid; about four point nine six percent (4.96%) by weight of lactic acid; mixed into ninety point nine five nine percent (90.959%) by weight of diluent with one point two eight percent (1.28%) weight of sodium chloride.

In a further embodiment the cleaning composition when in a ready-to-use form includes about zero point one seven six percent (0.176.%) by weight of citric acid; about zero point three one one percent (0.311%) by weight of lactic acid; mixed into ninety nine point four three percent (99.43%) by weight of diluent with zero point zero eight zero percent (0.080%) weight of sodium chloride. Preferably the composition includes a natural green dye and has a pH in the range of 1.0-2.5. More preferably in the range of 1.5-2.5.

Another embodiment of the present invention provides for the formulated cleaning composition having a pH of 1.5 to 2.0, and five percent (5%) to ten percent (10%) weight of the at least two organic acids.

In a further aspect of the present invention the formulated composition may include a gelling agent known to those skilled in the art, for contacting the cleaning composition to a vertical or horizontal surface/substrate.

A further aspect of the present invention provides for the cleaning composition to have no skin or ocular membrane or eye irritants within the formulation. Furthermore, the present formulation has also been shown not to be corrosive to the skin or ocular membrane of the eye.

In another aspect of the present invention there is provided a process for removal of soil and microorganisms from a surface/substrate including the steps of applying a disposable article to a target site of a surface/substrate/substrate in at least one direction; applying a dry cloth to the surface/substrate/substrate thereafter. The disposable article having been imbibed with the cleaning formulation of the present invention.

Another aspect of the present invention provides for a process to sequester soil laden microorganisms from a surface/substrate including the steps of contacting the surface/substrate with a solution; applying a dry cloth to the surface/substrate; and removing the imbibed cloth from the surface/substrate, the solution having the formulated composition of the present invention.

A further aspect of the present invention provides for a disposable article having a base sheet; with an aqueous solution of the present invention incorporated into the the base sheet. The sheet used for applying directly onto the target site with at least one swipe followed by the application of a dry cloth for removal of the microorganism laden soil.

An aspect of the invention provides for a system for sequestering and removal of soil and microorganisms from a surface/substrate including the steps of: applying a solution to a target site of a surface/substrate in at least one direction; applying a dry cloth to the surface/substrate thereafter; and removing the cloth. The cloth is imbibed with the cleaning formulation of the present invention. The imbibed cloth is reusable by machine or hand washing and then dried.

Other aspects, features, and details of the present invention can be more completely understood by reference to the following detailed description of the preferred embodiments, taken in conjunction with the examples, tables and from the appended claims.

DETAILED DESCRIPTION OF THE INVENTION

While this invention is susceptible of embodiment in many different forms, there are described several specific embodiments with the understanding that the present disclosure is to be considered as an exemplification of the principals of the invention and is not intended to limit the invention to the embodiments so described.

When a range is given in terms of a weight percent (wt. %) for a single component of a composite formulation, this means that the single component is present by weight in the composite formulation in the stated proportion relative to the sum total weight of all components of the composite formulation.

The present invention is directed to a formulated cleaning composition and process therefore, for rapidly dissolving and removing water deposits, soap scum, organic soils including fecal matter, urine and most soils spread from daily human activity. More specifically, the present invention provides a composition and method of use for removal of organic soils including pathogenic bacteria and bacterial spores alike to levels claimed by chemical existing disinfectants without the need for harmful solvents, surfactants or the like.

Due to the very nature of organic acids, they tend to be less corrosive, environmentally friendly and break down more rapidly than counterpart inorganic acids, which are often used in disinfectant cleaning solutions. Accordingly, the cleaning formulation of the present invention includes three principal components: at least two organic acids, and sodium chloride. The organic acid is C2-C8, more preferably C1-C7, even more preferably C2-C6, preferably carboxylic acid, a dicarboxylic acid, a tricarboxylic acid or a class of chemical compounds that consist of a carboxylic acid substituted with a hydroxyl group on the adjacent carbon. More preferably the carboxylic acid is citric acid and the carboxylic acid substituted with a hydroxyl group on the adjacent carbon is an alpha hydroxy acid. Even more preferably, the alpha hydroxy acid is a lactic acid. In another embodiment, the cleaning formulated composition of the present invention, includes effective amounts of carboxylic acids without the need for a surfactant. Preferably, the carboxylic acids are in varied quantities in the formulation and can range from about 0.1500 to about 3.000 (wt. %) of citric acid and from about 0.200 to about 6.00 (wt. %) of lactic acid. More preferably, citric acid is in the range of from about 0.180 to about 2.80 (wt. %) and the lactic acid is in the range of from about 0.300 to about 5.000 (wt. %). A concentrate of the formulation includes about 2.800 (wt. %) of citric acid with 4.9600 (wt. %) of lactic acid. In another embodiment, the carboxylic acids are mixed in solution with sodium chloride. More specifically, amounts of lactic acid, citric acid and sodium chloride are mixed with a diluent being sufficient to result in a formulation having commercial acceptable cleaning properties preferably for application on a surface/substrate. In another preferred embodiment the cleaning formulae includes from about one point six percent (1.0%) to two percent (2.0%) by weight of sodium chloride. The cleaning formulated composition of the present invention falls under the name of PCS FRICTION™ Concentrate or Spray or Wipe and provides an effective cleaning solution to known problems in the art without the need of surfactants that are generally used in disinfectant formulations. A ready-to-use or concentrate formulated composition of the present invention can include less or more sodium chloride, less citric acid and lactic acid.

In a further embodiment the formulated cleaning composition includes about three point zero percent (3.0%) citric acid; about six point two percent (6.2%) lactic acid with about one point six percent (1.6%) by weight sodium chloride in the ready-to-use formulation and about three point five percent (3.5%) by weight of citric acid, and six point five percent (6.5%) by weight of lactic acid for the concentrate formulation, mixed into deionized water forming the diluent. More preferably, the ready-to-use formulation includes (0.1760%) by weight of anhydrous citric acid; (0.3110%) by weight of lactic acid; (0.0800%) by weight of sodium chloride in (99.4329%) of diluent deionized water. In a further preferred embodiment the carboxylic acids and sodium chloride are mixed into about ninety nine point four three two nine percent (99.4329%) by weight of the diluent deionized water to form a solution. A more preferred embodiment for use in either a ready-to-use form or a concentrate form can include the formulation having a pH of 1.5 to 2.0, and zero point zero five percent (0.05%) to ten percent (10%) weight of the at least two organic acids.

A further embodiment of the present invention provides for the concentrate formulation to include 1.2800% by weight of sodium chloride; 2.800% by weight of anhydrous citric acid; 4.9600% by weight of lactic acid; 90.9590% by weight deionized diluent with 0.0010% by weight of green dye. In another embodiment a green dye is used, more particularly US Green (932). The cleaning composition has a pH in the range of about 1.5-2.5 and more preferably in the pH range of about 2.0-2.5. Another embodiment of the present invention provides for the formulated composition including a gelling agent known to those skilled in the art, for contacting the cleaning composition to a vertical or horizontal surface/substrate. One of ordinary skill in the art with the present disclosure before them will readily appreciate that other organic acids may be used within the scope of the present invention. The cleaning formulation can have a broad percentage range of components based on the ready-to-use formulation and that of the concentrate formulation, the variations are based on the proposed intended target use. Tables 1 and 2 provide examples of a formulation of the present invention showing all natural ingredients with no surfactant, perfumes or volatile ingredients as one would expect to find in commonly used disinfectants. However, the option to include a non-irritant or non-corrosive perfume or colour into the composition of the present invention should not be discounted. The present invention provides for the finding that the cleaning composition of the present invention is not a skin or ocular membrane or eye irritant. Moreover, the present invention provides for the formulated cleaning composition to be non-corrosive to the eyes or ocular membrane thereof.

Each one of the formulated compositions has provided a surprising effect on target sites as demonstrated from the majority of the examples provided. The tests of the formulated cleaning composition and the manner in which the composition was used provide a new practice of cleaning including but not limited to rapidly dissolving and removing water deposits, soap scum, organic soils including fecal matter, urine and most soils spread from daily human activity. More specifically, the present invention provides a formulation and method of use for removal of organic soils including pathogenic bacteria and bacterial spores alike to levels claimed by chemical existing disinfectants without the need for harmful solvents, surfactants or the like. Due to the very nature of organic acids, they tend to be less corrosive, environmentally friendly and break down more rapidly than counterpart inorganic acids, which are often used in disinfectant cleaning solutions. Accordingly, tests were carried out to determine for definite that the present formulation posed no harmful risk to the end user by carrying out an acute dermal and eye Irritation/Corrosion test of the PCS Friction formulation in Rabbits by an established pharmaceutical contract support organization for the applicant. The study was conducted according to Protocol No's PCS/250831 and PCS/250830. No signs of irritation were observed following the exposure period. Based on these results and a primary irritation index of 0.0, the irritating potential of the test item, PCS Friction, was found to be negligible, under the Environmental Protection Agency (EPA) Standard Evaluation Procedure Dermal Classification System and was not classified as a skin irritant under the Workplace Hazardous Materials Information System (WHMIS). In the proposed practice of use as demonstrated from the positive results attained, the formulated solution of the present invention was directed on or into the target substrate in at least one direction. Unlike existing disinfectant cleaning solutions that decrease the surface tension, the formulated composition of the present invention increased the surface tension of the surface/substrate, which increased the friction of the target site for dislodging and sequestering soil laden pathogens into the formulated solution. The aforementioned step of the proposed method was followed by a thorough drying of the target surface/substrate using a dry cloth or paper towel for wiping the surface/substrate dry, thereby physically removing residual soil, bacteria and bacterial spores.

PCS Friction uses disposable wipes or a spray application or other means known to those skilled in the art, followed by wiping the target site dry with disposable paper towels or cloths for further preventing the spread of disease causing microorganisms from, for example, washrooms. Accordingly, the formulated composition of PCS Friction meets the new World Federation of Building Service Contractors proposed cleaning standards for washroom and frequently touched surface/substrates.

Table 3, provides one of the test procedures used with the present formulation which is preferably used in combination with a process of the present invention for dissolving soil and loosening adhered bacteria, bacterial spores and soil for removal of soil and microorganisms from a surface/substrate. Preferably, the process includes contacting the surface/substrate with a solution of the PCS Friction either as an imbibed abrasive cloth, for example, PCS Friction Wipes, as a spray or other means as would be appreciated by those of skill in the art. Preferably, a sprayed application of the PCS Friction Concentrate to the surface/substrate is in a preferred diluted solution of 20 parts water to 1 part PCS Friction Concentrate.

In another preferred method for using the formulae of the of the present invention a pre-dampened cloth with a solution of PCS Friction (either the concentrate diluted 256 parts water with 1 part cleaner) or an alternative suitable dilution for variable target sites, is wiped on a surface/substrate in at least one direction making contact with the surface/substrate of the substrate target site and increasing the surface/substrate tension and subsequent friction for dislodging and sequestering soil laden pathogens into the formulated solution. The aforementioned steps having been followed by a thorough drying of surface/substrate using a dry cloth or paper towel for wiping the surface/substrate dry, thereby physically removing residual soil, bacteria and bacterial spores. Another embodiment of the present invention provides for the process of a laundering/decontamination process of PCS Friction microfibre cloths to insure the cloths continue to perform efficiently after hundreds of laundry cycles.

An example of the formulations illustrating certain preferred embodiments of the inventive cleaning products of the present invention are described in detail in Tables 1 and 2 below and were formulated generally in accordance with the protocol of those applicable examples. The formulation in Table 1 represents an example of a ready-to-use formulation of the PCS Friction formulated composition.

TABLE 1

| Ingredients | % W/W | Weight |
|---|---|---|
| DI Water | 99.4329 | 0.99731 |
| Sodium Chloride | 0.0800 | 0.00080 |
| citric acid, anh. | 0.1760 | 0.00177 |
| lactic acid, 88% | 0.3110 | 0.00312 |
| US Green (colour) | 0.0001 | 0.0000 |
| | 100.0000 | 1.0030 |

Table 1. provides a PCS Friction ready-to-use formulation of the present invention showing all natural ingredients with no surfactant, perfumes or volatile ingredients. The ready-to-use formulation has a specific gravity of about 1.003 and a pH of about pH 2.56.

An example of a concentrate formulation in Table 2., (PCS Friction Concentrate) includes less diluent/deionized water with an increase in the other constituents having an acceptable range in accordance with Workplace Hazardous Materials Information System (WHIMS) requirements.

TABLE 2

| Ingredients | % W/W | Weight |
|---|---|---|
| DI Water | 90.9590 | 0.92505 |
| Sodium Chloride | 1.2800 | 0.01302 |
| citric acid, anh. | 2.8000 | 0.02848 |
| lactic acid, 88% | 4.9600 | 0.05044 |
| US Green (colour) | 0.0010 | 0.0001 |
| | 100.0000 | 1.0170 |

Table 2. provides a PCS Friction Concentrate formulation of the present invention showing all natural ingredients with no surfactant, perfumes or volatile ingredients. The concentrate formulation has a specific gravity of 1.017 and a pH 1.79.

In regard of the results provided in Tables 3 and 4, Adenosine Trio Phosphate (ATP) hygiene monitoring provided accurate and traceable verification of the hygienic status of the select surface/substrate pre and post deep clean. The results measured in RLU's (Relative Light Units) indicated either a high value showing a high number of bacteria present, while a low number indicates few bacteria present. After cleaning, all sources of ATP showed significant reduction.

Assessing the cleanliness of a surface/substrate immediately after cleaning ensured contamination has been removed. The tests were carried out based on the premise that when left on a surface/substrate, residues can harbour and grow bacteria, cause cross-contamination, develop biofilm and many other problems that can compromise product quality. Accordingly, due to the very nature of microbial contamination, metabolic processes found, for example, in micro-organisms use ATP as an energy source convert it back into its precursors. ATP is therefore continuously recycled in micro-organisms including pathogens.

When ATP was brought into contact with a testing device, for example, the Hygiena ATP monitoring system, light was emitted in direct proportion to the amount of ATP present. The system measured the amount of light generated and provided information on the level of contamination. The higher the reading, the more contamination was present.

Product Review—Review ATP Levels Pre and Post Clean

Hygiena ATP monitoring: PASS=0 to 30 RLU FAIL=Greater than 30 RLU

To provide further verification of the positive application and use of the PCS Friction formulation of the present invention with the associated process of removal, a majority of the examples provide the tested protocols and the results of the deep cleaning validation process. The test results also provide what is considered to be the acceptable standard following the internationally specified acceptable microbial count of food-processing equipment, which is set at less than 5 colony forming units per centimeter squared (<5 cfu/cm$^2$). Accordingly, any count below five cfu/cm$^2$ or less is considered a pass.

PCS Friction Deep Cleaning Process Validation Test

EXAMPLE I

Test Conditions

Challenge Organism: *Bacillus subtilus* ATCC 19659

Initial Titre: Clean surface/substrate

Soil Load: No intended soil load

Culture Application: No culture applied

Test surface/substrate: 1380 cm$^2$ stainless steel surface/substrate

Method

A clean test surface/substrate demarcated with ten (10) 1 cm$^2$ test areas was prepared prior to testing. Immediately after wiping the bleach testing surface/substrate with the cloth soaked in bleach, the same cloth was used to wipe the uncontaminated, clean surface/substrate. The surface/substrate was then sampled for post cleaning values immediately after wiping to assess cross contamination activity.

TABLE 2

| *C. difficile* positive patient room | Prior to cleaning | After cleaning with PCS Friction** (time 10:30) | Resulting Change | After Bleach (Time 13:30) ➡ | Resulting Change | BioBurden (Time 16:30) ➡ | Resulting Change |
|---|---|---|---|---|---|---|---|
| 1 Bed Rail | 301 | 57 | −244 | 4 | −53 | 8 | 4 |
| 2 Overbed Table | 1238 | 61 | −1177 | 7 | −54 | 18 | 11 |
| 3 Call Button | 1237 | 19 | −1218 | 14 | −5 | 119 | 105 |
| 4 Toilet Seat T/B | 41 | 6 | −35 | 0 | −6 | 0 | 0 |
| 5 Light Switch/ Sink/Flusher | 554 | 7 | −547 | 0 | −7 | 0 | 0 |
| Average ATP | 674 | 30 | PASS | 5 | PASS | 20 | PASS |

**New microfibre PCS 1000 ppm pre-moistened wipes

TABLE 3

| VRE Positive Patient Room | Prior to cleaning Day 1 | After cleaning with Virox* (time 10:30) | Resulting Change | Prior to Cleaning Day 2 ➡ | After cleaning with PCS Friction ™** @10:30 | Resulting Change |
|---|---|---|---|---|---|---|
| 1 Bed Rail | 400 | 134 | −266 | 265 | 19 | −246 |
| 2 Overbed Table | 35 | 30 | −5 | 17 | 24 | 7 |
| 3 Call Button | 21 | 10 | −11 | 32 | 32 | −5 |
| 4 Toilet Seat T/B | 48 | 2 | −46 | 14 | 7 | −7 |
| 5 Light Switch/ Sink/Flusher | 142 | 27 | −115 | 12 | 12 | 3 |
| Average ATP | 129 | 40 | FAIL | 68.6 | 18.8 | PASS |

*old microfibre

**new microfibre

Test Data

TABLE 4

| Postvalues | |
|---|---|
| Replicate | 1.0 mL |
| 1 | 0 |
| 2 | 0 |
| 3 | 0 |
| 4 | 0 |
| 5 | 0 |
| 6 | 1 |
| 7 | 0 |
| 8 | 0 |
| 9 | 0 |
| 10 | 0 |

Average cfu/cm$^2$ post cleaning: <1.55

Test Results

The internationally specified acceptable microbial count of food-processing equipment is <5 cfu/cm$^2$. Accordingly the test result is a PASS.

EXAMPLE II

PCS Friction Deep Cleaning Process Validation Test

Test Conditions

Challenge Organism: *Bacillus subtilus* ATCC 19659

Soil Load: 6 g/L bovine serum albumin—simulated dirty conditions

Culture Application: 0.1 ml of inoculum spread over (one) 6.45 cm$^2$ square and dried for 1 (one) hour at 35° C.

Test surface/substrate: 1380 cm' stainless steel surface/substrate

Method

Thirteen (13) 6.45 cm$^2$ squares were demarcated on the test surface/substrate prior to incubation. All squares were inoculated and allowed to dry prior to testing. Three (3) 6.45 cm$^2$ areas on the test surface/substrate were swabbed prior to cleaning to obtain prevalues and assess initial titre. Clean microfibre cloths were soaked in tap water. The cloth was wrung out and the surface/substrate was then wiped down with the cloth (one swipe with pressure applied across the test surface/substrate area). 10 (ten) 6.45 cm$^2$ areas on the test surface/substrate were then immediately swabbed for post-cleaning values.

Test Data

TABLE 5

| Prevalues | | | |
|---|---|---|---|
| | Dilution | | |
| Replicate | $10^{-3}$ | $10^{-4}$ | $10^{-5}$ |
| 1 | 26/25 | 0/0 | 0 |
| 2 | 22/30 | 3/2 | 0 |
| 3 | 12sp/15sp | 1/0 | 0 |

Prevalue Average cfu/cm$^2$: 403

TABLE 6

| Postvalues | |
|---|---|
| Replicate | Dilution $10^{-1}$ |
| 1 | 0 |
| 2 | 10 |

TABLE 6-continued

| Postvalues | |
|---|---|
| Replicate | Dilution $10^{-1}$ |
| 3 | 0 |
| 4 | 1780 |
| 5 | 0 |
| 6 | 0 |
| 7 | 10 |
| 8 | 0 |
| 9 | 30 |
| 10 | 80 |

Average cfu/cm$^2$ post cleaning: 30

Test Results

The internationally specified acceptable microbial count of food-processing equipment is <5 cfu/cm$^2$. Accordingly the test result is a FAIL due to the use of tap water.

EXAMPLE III

PCS Friction Deep Cleaning Process Validation Test

Test Conditions

Challenge Organism: *Bacillus subtilus* ATCC 19659

Soil Load: 6 g/L bovine serum albumin—simulated dirty conditions

Culture Application: 0.1 ml of inoculum spread over (one) 6.45 cm$^2$ square and dried for 1 (one) hour at 35° C.

Test surface/substrate: 1380 cm$^2$ stainless steel surface/substrate

Method

Thirteen (13) 1 cm$^2$ squares were demarcated on the test surface/substrate prior to incubation. All squares were inoculated and allowed to dry prior to testing. Three (3) 1 cm$^2$ areas on the test surface/substrate were swabbed prior to cleaning to obtain prevalues and assess initial titre. A solution of Clorox® bleach was prepared in water at 1:10 dilution. The solution was applied using a spray bottle covering the test surface/substrate. The test surface/substrate was wiped down using a clean PCS Friction cloth (one swipe across with normal pressure). The cloth was then used for the cross contamination test. Ten (10) 1 cm$^2$ areas on the test surface/substrate were then immediately swabbed for post-cleaning values.

Test Data

TABLE 7

| Prevalues | | | |
|---|---|---|---|
| | Dilution | | |
| Replicate | $10^{-3}$ | $10^{-4}$ | $10^{-5}$ |
| 1 | 50/49 | 5/11 | 0 |
| 2 | 42/45 | 7/8 | 0 |
| 3 | 43/45 | 8/8 | 0 |

Prevalue Average cfu/cm$^2$: $7.1 \times 10^{-3}$

TABLE 8

| Postvalues | |
|---|---|
| Replicate | Dilution $10^{-1}$ |
| 1 | 0 |
| 2 | 20 |
| 3 | 10 |
| 4 | 30 |
| 5 | 10 |
| 6 | 40 |
| 7 | 0 |
| 8 | 60 |
| 9 | 0 |
| 10 | 40 |

Average cfu/cm$^2$ post cleaning: 3.0 cfu/cm$^2$

Test Results

The internationally specified acceptable microbial count of food-processing equipment is <5 cfu/cm$^2$. Accordingly the test result is a PASS.

EXAMPLE IV

PCS Friction Deep Cleaning Process Validation Test

Test Conditions

Challenge Organism: *Bacillus subtilus* ATCC 19659

Soil Load: 6 g/L bovine serum albumin—simulated dirty conditions

Culture Application: 0.1 ml of inoculum spread over (one) 6.45 cm$^2$ square and dried for 1 (one) hour at 35° C.

Test surface/substrate: 1380 cm$^2$ stainless steel surface/substrate

Method

Thirteen (13) 6.45 cm$^2$ squares were demarcated on the test surface/substrate prior to incubation. All squares were inoculated and allowed to dry prior to testing. Three (3) 6.45 cm$^2$ areas on the test surface/substrate were swabbed prior to cleaning to obtain prevalues and assess initial titre. Clean microfibre cloths were soaked in a solution containing PCS Friction, diluted in water at 1:256 for one (1) hour prior to testing. The test cleaning procedure involved spraying down the surface/substrate with a PCS Friction solution, diluted in water at 1:20. The surface/substrate was then wiped down with one of the previously dampened cloths (one swipe with pressure applied across the test surface/substrate area). Then the area was wiped dry with a clean, dry PCS Friction cloth. Ten (10) 6.45 cm$^2$ areas on the test surface/substrate were then immediately swabbed for post-cleaning values.

Test Data

TABLE 9

| Prevalues | | | |
|---|---|---|---|
| | Dilution | | |
| Replicate | $10^{-3}$ | $10^{-4}$ | $10^{-5}$ |
| 1 | 63/59 | 27 | 0 |
| 2 | 55/47 | 26 | 0 |
| 3 | 53/58 | 34 | 0 |

Pre-value Average cfu/cm$^2$: 8.7 × 10$^2$

TABLE 10

| Postvalues | |
|---|---|
| Replicate | Dilution $10^{-1}$ |
| 1 | 0 |
| 2 | 0 |
| 3 | 0 |
| 4 | 0 |
| 5 | 0 |
| 6 | 1 |
| 7 | 0 |
| 8 | 0 |
| 9 | 0 |
| 10 | 0 |

Average cfu/cm$^2$ post cleaning: <1.55 cfu/cm$^2$

Test Results

The internationally specified acceptable microbial count of food-processing equipment is <5 cfu/cm$^2$. Accordingly the test result is a PASS.

EXAMPLE V

PCS Friction Deep Cleaning Process Validation Test

Test Conditions

Challenge Organism: *Bacillus subtilus*

Initial titre: 2.2×10$^6$

Soil Load: 6 g/L bovine serum albumin—simulated dirty conditions

Culture Application: 0.1 ml of inoculum spread over 1 (one) 6.45 cm$^2$ square and dried for 1 (one) hour at 35° C.

Test surface/substrate: 1380 cm$^2$ stainless steel surface/substrate

Method

A clean test surface/substrate was sampled prior to cleaning to obtain pre-values and assess initial titre. A solution of Clorox® Bleach was prepared in water at 1:10 dilution. The solution was applied using a spray bottle covering the test surface/substrate. The test surface/substrate was wiped down using a clean PCS Friction cloth (one swipe across with normal pressure).

Test Data

TABLE 11

| Pre-values | | | | |
|---|---|---|---|---|
| | Dilution | | | Mean |
| Replicate | $10^{-4}$ | $10^{-5}$ | $10^{-6}$ | ×10$^{-4}$ |
| 1 | 247 | 23 | 0 | 239 |
| 2 | 234 | 24 | 0 | 237 |
| 3 | N/A | 18 | 0 | 180 |

Pre-value Average cfu/cm$^2$: 3.7 × 10$^3$

TABLE 12

| Post-values | | | |
|---|---|---|---|
| | Dilution | | |
| Replicate | $10^0$ | $10^{-1}$ | Mean |
| 1 | 10 | 1 | 10 |
| 2 | 0 | 0 | 0 |
| 3 | 0 | 0 | 0 |

Average cfu/cm$^2$ post cleaning: <1.55 cfu/cm$^2$

Test Results

The internationally specified acceptable microbial count of food-processing equipment is <5 cfu/cm$^2$. Accordingly the test result is a PASS.

EXAMPLE VI

PCS Friction Deep Cleaning Process Validation Test

Test Conditions

Challenge Organism: *Bacillus subtilus*

Initial titre: $2.7\times10^6$

Soil Load: 6 g/L bovine serum albumin—simulated dirty conditions

Culture Application: 0.1 ml of inoculum spread over 1 (one) 6.45 cm$^2$ square and dried for 1 (one) hour at 35° C.

Test surface/substrate: 1380 cm$^2$ stainless steel surface/substrate

Method

The test surface/substrate was sampled prior to cleaning to obtain pre-values and assess initial titre.

Clean microfibre cloths were soaked in a solution containing PCS Friction, diluted in water at 1:256 for one hour prior to testing. The test cleaning procedure involved spraying down the surface/substrate with the PCS Friction solution, diluted in water at 1:20. The surface/substrate was then wiped down with one of the previously dampened cloths (one swipe with pressure applied across the test surface/substrate area). The area was wiped dry with a clean, dry cloth.

Test Data

TABLE 13

| Pre-values | | | | |
|---|---|---|---|---|
| | Dilution | | | Mean |
| Replicate | $10^{-4}$ | $10^{-5}$ | $10^{-6}$ | $\times10^{-4}$ |
| 1 | 277 | 27 | 0 | 274 |
| 2 | 250 | 26 | 0 | 255 |
| 3 | 242 | 34 | 0 | 291 |

Pre-value Average cfu/cm$^2$: $4.3\times10^{-3}$

TABLE 14

| Post-values | | | |
|---|---|---|---|
| | Dilution | | |
| Replicate | $10^0$ | $10^{-1}$ | Mean |
| 1 | 0 | 0 | 0 |
| 2 | 0 | 0 | 0 |
| 3 | 0 | 0 | 0 |

Average cfu/cm$^2$ post cleaning: <1.55 cfu/cm$^2$

Test Results

The internationally specified acceptable microbial count of food-processing equipment is <5 cfu/cm$^2$. Accordingly the test result is a PASS.

EXAMPLE VII

PCS Friction Deep Cleaning Process Validation Test

Test Conditions

Challenge Organism: *Escherichia coli, Staphylococcus aureus, Pseudonomas aeruginosa*

Initial titre: $9.5\times10^7$

Soil Load: 6 g/L bovine serum albumin—simulated dirty conditions

Culture Application: 0.1 ml of inoculum spread over 1 (one) 6.45 cm$^2$ square and dried for 1 (one) hour at 35° C.

Test surface/substrate: 1380 cm' stainless steel surface/substrate

Method

The test surface/substrate was sampled prior to cleaning to obtain pre-values and assess initial titre. Clean microfibre cloths were soaked in a solution containing PCS Friction, diluted in water at 1:256 for one hour prior to testing. The test cleaning procedure involved spraying down the surface/substrate with the PCS Friction solution, diluted in water at 1:20. The surface/substrate was then wiped down with one of the previously dampened cloths (one swipe with pressure applied across the test surface/substrate area). The area was wiped dry with a clean, dry microfibre cloth.

Test Data

TABLE 15

| Pre-values | | | | |
|---|---|---|---|---|
| | Dilution | | | Mean |
| Replicate | $10^{-7}$ | $10^{-6}$ | $10^{-5}$ | $\times10^{-5}$ |
| 1 | 1 | 16 | 115 | 115 |
| 2 | 1 | 16 | 87 | 87 |
| 3 | 1 | 7 | 82 | 82 |

Pre-value Mean: $9.5\times10^7$

TABLE 16

| Post-values | | | |
|---|---|---|---|
| | Dilution | | |
| Replicate | $10^0$ | $10^{-1}$ | Mean |
| 1 | 0 | 0 | 0 |
| 2 | 0 | 0 | 0 |
| 3 | 0 | 0 | 0 |

Average cfu/cm$^2$ post cleaning: <1.55 cfu/cm$^2$

Test Results

The internationally specified acceptable microbial count of food-processing equipment is <5 cfu/cm$^2$. Accordingly the test result is a PASS.

EXAMPLE VIII

PCS Friction Deep Cleaning Process Validation Test

Test Conditions

Challenge Organism: *Bacillus subtilus*

Initial titre: $3.3\times10^6$

Soil Load: 6 g/L bovine serum albumin—simulated dirty conditions

Culture Application: 0.1 ml of inoculum spread over 1 (one) 6.45 $cm^2$ square and dried for 1 (one) hour at 35° C.

Test surface/substrate: 1380 $cm^2$ stainless steel surface/substrate

Method

The test surface/substrate was sampled prior to cleaning to obtain pre-values and assess initial titre. Oxyvir (a disinfectant) was applied using a spray bottle, covering the test surface/substrate. The test surface/substrate was wiped down using a clean microfibre cloth (one swipe across with normal pressure).

Test Data

TABLE 17

| Pre-values | | | | |
|---|---|---|---|---|
| | Dilution | | | Mean |
| Replicate | $10^{-2}$ | $10^{-4}$ | $10^{-5}$ | $\times 10^4$ |
| 1 | 220 | 24 | 0 | 230 |
| 2 | 270 | 49 | 2 | 380 |
| 3 | 300 | 47 | 3 | 385 |

Pre-value Average cfu/$cm^2$: $5.4 \times 10^4$

TABLE 18

| Post-values | | | |
|---|---|---|---|
| | Dilution | | |
| Replicate | $10^0$ | $10^{-1}$ | Mean |
| 1 | 0 | 0 | 0 |
| 2 | 0 | 0 | 0 |
| 3 | 0 | 0 | 0 |

Average cfu/$cm^2$ post cleaning: 5.7 cfu/$cm^2$

Test Results

The internationally specified acceptable microbial count of food-processing equipment is <5 cfu/$cm^2$. Accordingly the test result showed that Oxyvir does not reduce the the cfu/$cm^2$ down to the acceptable level below the 5 cfu/$cm^2$ mark and as such is a FAIL.

EXAMPLE IX

PCS Friction Deep Cleaning Process Validation Test

Test Conditions

Challenge Organism: *Bacillus subtilus* ATCC 19659

Initial titre: $1.2 \times 10^{-3}$ cfu/$cm^2$

Soil Load: 6 g/L bovine serum albumin—simulated dirty conditions

Culture Application: 0.1 ml of inoculum spread over 1 (one) 6.45 $cm^2$ square and dried for 1 (one) hour at 35° C.

Test surf ace/substrate: 1380 $cm^2$ stainless steel surface/substrate

Method

Thirteen (13) 6.45 $cm^2$ squares were demarcated on the test surface/substrate prior to inoculation. All squares were inoculated and allowed to dry prior to testing. Three (3) 6.45 $cm^2$ square areas on the test surface/substrate were swabbed prior to cleaning to obtain pre-values and assess initial titre. The test cleaning procedure involved wiping down the surface/substrate with a PCS Friction Wipe. The area was wiped until completely dry with a clean, dry cotton cloth. Ten (10) 6.45 $cm^2$ square areas on the test surface/substrate were then immediately swabbed for post-cleaning values.

Test Data

TABLE 19

| Pre-values (cfu) | | | |
|---|---|---|---|
| | Dilution | | |
| Replicate | $10^{-2}$ | $10^{-3}$ | $10^{-4}$ |
| 1 | 113 | 10 | 1 |
| 2 | 70 | 10 | 2 |
| 3 | 49 | 5 | 0 |

Pre-value Average cfu/$cm^2$: $1.2 \times 10^{-3}$

TABLE 20

| Post-values (cfu) | |
|---|---|
| Replicate | Dilution $10^{-1}$ |
| 1 | <10 |
| 2 | <10 |
| 3 | <10 |
| 4 | 6 |
| 5 | <10 |
| 6 | <10 |
| 7 | <10 |
| 8 | 1 |
| 9 | <10 |
| 10 | <10 |

Average cfu/$cm^2$ post cleaning: <1.55

Test Results

The test results demonstrate a PASS in accordance with the internationally specified acceptable microbial count on food-processing equipment which is <5 cfu/$cm^2$.

EXAMPLE X

PCS Friction Deep Cleaning Process Validation Test

Test Conditions

Challenge Organism: *Bacillus subtilus* ATCC 19659

Initial titre: $1.23 \times 10^{-3}$ cfu/$cm^2$

Soil Load: 6 g/L bovine serum albumin—simulated dirty conditions

Culture Application: 0.1 ml of inoculum spread over 1 (one) 6.45 $cm^2$ square and dried for 1 (one) hour at 35° C.

Test surface/substrate: 1380 $cm^2$ stainless steel surface/substrate

Method

Thirteen (13) 6.45 $cm^2$ squares were demarcated on the test surface/substrate prior to inoculation. All squares were inoculated and allowed to dry prior to testing. Three (3) 6.45 $cm^2$ square areas on the test surface/substrate were swabbed prior to cleaning to obtain pre-values and assess initial titre. The test cleaning procedure involved wiping down the surface/substrate with a PCS Friction Wipe. The area was allowed to air dry until completely dry. Ten (10) 6.45 $cm^2$ square areas on the test surface/substrate were then immediately swabbed for post-cleaning values.

Test Data

TABLE 21

| Pre-values (cfu) | | | |
|---|---|---|---|
| | Dilution | | |
| Replicate | $10^{-3}$ | $10^{-4}$ | $10^{-5}$ |
| 1 | 124 | 14 | 0 |
| 2 | 54 | 10 | 0 |
| 3 | 74 | 18 | 0 |

Pre-value Average cfu/cm$^2$: $1.3 \times 10^{-3}$

TABLE 22

| Post-values (cfu) | |
|---|---|
| Replicate | Dilution $10^{-1}$ |
| 1 | 42 |
| 2 | 6 |
| 3 | 38 |
| 4 | 9 |
| 5 | 27 |
| 6 | 8 |
| 7 | 1 |
| 8 | 10 |
| 9 | 11 |
| 10 | 10 |

Average cfu/cm$^2$ post cleaning: 25 cfu/cm$^2$

Test Results

The test results demonstrate that leaving a test area to air dry as oppose to the recommended process of the present invention, the test results showed a FAIL in accordance with the internationally specified acceptable microbial count on food-processing equipment which is <5 cfu/cm$^2$.

EXAMPLE XI

PCS Friction Deep Cleaning Process Validation Test

Test Conditions

Challenge Organism: *Bacillus subtilus* ATCC 19659

Initial titre: $1.4 \times 10^{-3}$ cfu/cm$^2$

Soil Load: 6 g/L bovine serum albumin—simulated dirty conditions

Culture Application: 0.1 ml of inoculum spread over 1 (one) 6.45 cm$^2$ square and dried for 1 (one) hour at 35° C.

Test surface/substrate: 1380 cm$^2$ stainless steel surface/substrate

Method

Thirteen (13) 6.45 cm$^2$ squares were demarcated on the test surface/substrate prior to inoculation. All squares were inoculated and allowed to dry prior to testing. Three (3) 6.45 cm$^2$ square areas on the test surface/substrate were swabbed prior to cleaning to obtain pre-values and assess initial titre. PCS Friction Concentrate was diluted at 50 ml/L with water, and used to saturate 15 PCS Friction (micro-fibre) cloths for 1 (one) hour. The test surface/substrate was wiped with a pre-moistened cloth, then dried completely with another dry micro-fibre cloth. Ten (10) 6.45 cm$^2$ square areas on the test surface/substrate were then immediately swabbed for post-cleaning values.

Test Data

TABLE 23

| Pre-values (cfu) | | | |
|---|---|---|---|
| | Dilution | | |
| Replicate | $10^{-2}$ | $10^{-3}$ | $10^{-4}$ |
| 1 | 105 | 10 | 0 |
| 2 | 82 | 5 | 0 |
| 3 | 78 | 9 | 0 |

Pre-value Average cfu/cm$^2$: $1.4 \times 10^{-3}$

TABLE 24

| Post-values (cfu) | |
|---|---|
| Replicate | Dilution $10^{-1}$ |
| 1 | 4 |
| 2 | <10 |
| 3 | 3 |
| 4 | <10 |
| 5 | 7 |
| 6 | <10 |
| 7 | 5 |
| 8 | <10 |
| 9 | 2 |
| 10 | 0 |

Average cfu/cm$^2$ post cleaning: 3.0 cfu/cm$^2$

Test Results

The test results demonstrate a PASS in accordance with the internationally specified acceptable microbial count on food-processing equipment which is <5 cfu/cm$^2$.

EXAMPLE XII

PCS Friction Deep Cleaning Process Validation Test

Test Conditions

Challenge Organism: *Bacillus subtilus* ATCC 19659

Initial titre: $1.6 \times 10^{3}$ cfu/cm$^2$

Soil Load: 6 g/L bovine serum albumin—simulated dirty conditions

Culture Application: 0.1 ml of inoculum spread over 1 (one) 6.45 cm$^2$ square and dried for 1 (one) hour at 35° C.

Test surface/substrate: 1380 cm$^2$ stainless steel surface/substrate

Method

Thirteen (13) 6.45 cm$^2$ squares were demarcated on the test surface/substrate prior to inoculation. All squares were inoculated and allowed to dry prior to testing. Three (3) 6.45 cm$^2$ square areas on the test surface/substrate were swabbed prior to cleaning to obtain pre-values and assess initial titre. PCS Friction Spray was applied using a spray bottle to cover the test surface/substrate. The test surface/substrate was wiped and dried completely using a clean paper towel. Ten (10) 6.45 cm$^2$ square areas on the test surface/substrate were then immediately swabbed for post-cleaning values.

Test Data

TABLE 25

| Pre-values (cfu) | | | |
|---|---|---|---|
| | Dilution | | |
| Replicate | $10^{-2}$ | $10^{-3}$ | $10^{-4}$ |
| 1 | 100 | 11 | 0 |
| 2 | 100 | 18 | 0 |
| 3 | 112 | 14 | 0 |

Pre-value Average cfu/cm$^2$: $1.6 \times 10^{-3}$

TABLE 26

| Post-values (cfu) | |
|---|---|
| Replicate | Dilution $10^{-1}$ |
| 1 | <10 |
| 2 | <10 |
| 3 | <10 |
| 4 | <10 |
| 5 | <10 |
| 6 | 10 |
| 7 | <10 |
| 8 | <10 |
| 9 | <10 |
| 10 | <10 |

Average cfu/cm$^2$ post cleaning: <1.55 cfu/cm$^2$

Test Results

The test results demonstrate a PASS in accordance with the internationally specified acceptable microbial count on food-processing equipment which is <5 cfu/cm$^2$.

The above test results showing fewer than five colony forming units per centimeter square, as carried out by an independent third party laboratory, demonstrate that the PCS Friction Deep Cleaning Process and PCS Cleaning materials therefore, that are the subject of the present invention, exhibit a demonstrated physical removal of 99.9999% (a six log reduction) in bacteria and bacterial spores in the presence of artificial soil, with all post cleaning tests showing no reported colony growth.

The formulated cleaning composition of the present invention has not only shown the effectiveness against microbial pathogens but also provides end user handling/exposure details as being safe. The following test examples, carried out for the applicant by an independent established pharmaceutical contract support organization, provide an example of how safe the formulated cleaning composition of the present invention actually is.

Test PCS/250831

The Acute Dermal Irritation/Corrosion Test of PCS Friction in Rabbits was carried out by the established pharmaceutical contract support organization for the applicant. The study was conducted according to Protocol No's PCS/250831. One animal was used initially to evaluate the test item. A dose of 0.5 mL of the test item was topically applied by patch application to a chosen intact test area on the skin of the rabbit. The test item stayed in contact with the skin for a 4-hour period using a semi-occlusive dressing. An untreated control site was concurrently run. Since a corrosive effect was not observed in the initial animal, a confirmatory test was performed on two additional animals. The same application procedures were followed. For the initial animal, test sites were evaluated immediately following the exposure period and again at 1, 24, 48 and 72 hours. For the confirmatory animals, test sites were evaluated at 1, 24, 48 and 72 hours following the exposure period.

No signs of irritation were observed following the exposure period. Based on these results and a primary irritation index of 0.0, the irritating potential of the test item, PCS Friction, was found to be negligible, under the Environmental Protection Agency (EPA) Standard Evaluation Procedure Dermal Classification System and was not classified as a skin irritant under the Workplace Hazardous Materials Information System (WHMIS).

Test Item

Name: PCS Friction

Colour/Form: Clear, green liquid

Lot No. L0341201

Composition: Water, lactic acid, citric acid, sodium chloride, S Green

CAS No.: N/A

Expiry Date: N/A pH: 1.79

Specific Gravity: 1.017

Storage Conditions: Ambient Temperature (15-30° C.)

Handling Precautions: As per Material Safety Data Sheet

Supplier: Applicant

I. Method

The method used for conducting this study is the accepted standard described in OECD Guideline for the Testing of Chemicals, Acute Dermal Irritation/Corrosion, Section 404, 2002(1). The study was conducted in accordance with the pharmaceutical contract support organization Protocol PCS/250831.

II. Justification for Selection of Test System

The albino rabbit is the preferable species for use in skin irritation/corrosion studies. This test system is internationally recognized and acceptable to regulatory authorities requiring skin irritation testing.

III. Test System

Species: *Oryctolagus cuniculus*

Strain: New Zealand Albino (Crl:KBL(NZW)BR)

Source: N/A

Number and Sex: 3 Females

Body Weight Range: 2.3-2.4 kg

Acclimatization Period: 14 days

Age at Start of Study: Approximately 13 to 14 weeks

Animal Identification: ear tags, cage labels

Experimental Procedures

Animal Preparation: Approximately 24 hours prior to testing, the dorsal area of the trunk of each rabbit was closely clipped free of hair. The exposed skin of each rabbit was divided into 2-3.0×3.0 cm areas with a marker representing 2 intact areas.

Dose Level: A dose of 0.5 mL of the test item was applied to the test site.

Test Item Preparation: None. The test item was administered as is.

Dose Administration:

The test item was applied to an approximately 6 cm2 area, and covered with a gauze patch. Since the test item was a liquid, it was first applied to the gauze patch, which was then applied to the skin. The patch was attached to the skin and loosely held in contact by using Blenderm™—hypoallergenic surgical tape. The whole trunk of the animal was then wrapped by means of a semi-occlusive dressing and secured with tape (Zonas porous tape) for a 4-hour exposure period. The untreated site of the animal served as the control. After 4 hours, the wrappings, patch and the test item were removed and the skin was cleansed with USP Sterile Water for Injection. An initial test was performed using one animal to evaluate the test item. As no corrosive effect was observed in the initial test, a confirmatory test was performed in a similar manner on two additional animals.

Clinical Examination and Scoring:

All sites were examined for signs of erythema and oedema, and the responses scored at 1, 24, 48 and 72 hours, following removal of the patches. For the initial test on one animal, the test and control sites were also examined immediately after the patch was removed. The scoring system described in the "OECD Guideline For The Testing Of Chemicals", Section 404, (OECD, 2002)(1) was used in evaluating the degree of irritancy of each tested site.

Test PCS/250830

The Acute Eye Irritation/Corrosion Test of PCS Friction was carried out again by the established pharmaceutical contract support organization for the applicant according to Study Plan PCS/250830. One animal was used initially to evaluate the test item. A dose of 0.1 mL of the test item, as supplied by the Sponsor, was instilled in the conjunctival sac of one eye of the rabbit. The other eye remained untreated and served as the control. The eye of the rabbit was not washed post test item instillation. As a corrosive effect was not observed in the initial animal, a confirmatory test was performed in a similar manner on two additional animals. Irritancy evaluations using standard Draize scoring system were carried out at 1, 24, 48, 72 hours and on Day 7 following test item instillation. The conjunctivae of all animals showed signs of redness (Score 1) involving hyperaemic blood vessels from 1 hour to 72 hours after test item instillation. Conjunctival chemosis Score 1) was observed on all animals from 1 hour to 48 hours post dosing. Conjunctival discharge was also observed on all animals (Score 1) from 1 hour to 48 hours post test item instillation. All animals recovered to normal by Day 7 after test item instillation. Based on these observations, the test item, PCS Friction was classified as mildly to moderately irritating, under the Interpretation of Eye Irritation Tests, Journal of the Society of Cosmetic Chemists, and was not classified as an eye irritant under the Workplace Hazardous Materials Information System (WHMIS).

Test Item

Name: PCS Friction

Colour/Form: Clear, green liquid

Lot No. L0341201

Composition: Water, lactic acid, citric acid, sodium chloride, S Green

CAS No.: N/A

Expiry Date: N/A pH: 1.79

Specific Gravity: 1.017

Storage Conditions: Ambient Temperature (15-30° C.)

Handling Precautions: As per Material Safety Data Sheet

Supplier: Applicant

I. Method

The method used for conducting this study is the accepted standard described in OECD Guideline for the Testing of Chemicals, Acute Eye Irritation/Corrosion, Section 405, (OECD, 2002)(1). The study was conducted in accordance with the pharmaceutical contract support organization Protocol No. PCS/250830.

II. Justification for Selection of Test System

The albino rabbit is the preferable species for use in eye irritation studies.

III. Test System

Test Animal: *Oryctolagus cuniculus*

Strain: New Zealand Albino (Crl:KBL(NZW)BR)

Source: N/A

Number and Sex: 3 Females

Body Weight Range: 2.4-2.7 kg

Acclimatization Period: 14 days

Age at Study Start: Approximately 13-14 weeks

Animal Identification: ear tags, cage labels

Animal Selection

The test population of animals was selected from fully acclimatized newly arrived rabbits. All animals used in the study were purchased from the same supplier and were of identical strain. The selection procedure involved the examination of both eyes of each animal. Only animals showing no eye irritation, ocular defects, or pre-existing corneal injury were selected.

Experimental Procedures

Animal Preparation

Both eyes of each experimental animal provisionally selected for testing were examined within 24 hours before testing started. Only animals showing no eye irritation, ocular defects, or pre-existing corneal injury were used.

Dose Level: a dose of 0.1 mL was used.

Test Item Preparation:

None. The test item was administered as is.

Dose Administration

An initial test was performed using one animal, to evaluate the test item. The test item was placed in the conjunctival sac of one eye of the animal, after gently pulling the lower lid away from the eyeball. The lids were then held together for about one second in order to prevent loss of material. The other eye remained untreated to serve as a control. As no corrosion was observed in the initial test, the confirmatory test was performed in a similar manner on two additional animals. Following the application, the rabbits were kept restrained for one hour and then returned to their cages.

Clinical Examination and Scoring

The eyes were examined at 1, 24, 48, 72 hours and on Day 7 after test item instillation. The grades of ocular reaction (conjunctivae, cornea, and iris) were recorded at each examination. The examination of the eyes was made by using a hand slit-lamp, and also made under a white room light. 48 hours post test item instillation, fluorescein sodium ophthalmic strips were moistened with 0.9% Sterile Sodium Chloride for Injection U.S.P. and the resulting solution was applied directly to the cornea. Any excess amount was rinsed with 0.9% Sterile Sodium Chloride for Injection U.S.P. The cornea was examined in a darkened room under ultraviolet illumination for opacity and area of opacity.

Evaluation of Results

Ocular lesions were determined for each parameter and each observation according to the scoring system. The test item was then classified. The test item was also evaluated for the Workplace Hazardous Materials Information System (WHMIS) as in Table 3 OECD, 2002(1).

Animal Housing and Maintenance for Both Tests PCS/250830 and PCS/250831

Upon arrival into the facility, each animal underwent an individual physical examination by a qualified animal care technician and was then assigned an identification number (ear tag). An individual animal record was maintained. The animals were then admitted to a quarantine room for a 14-day acclimatization period. The animal room environment was controlled (targeted ranges: temperature 18° C.-26° C., relative humidity 30-70%, minimum 15 air changes/hour) and monitored. The photo-cycle was 12 hours dark and 12 hours light. Animals were housed in individual stainless steel cages and administered approximately 200 g of Teklad Rabbit Diet and water ad libitum daily. The cage cleaning schedule, air filtration and recirculation, health checks and facility maintenance were carried out in accordance with the applicable pharmaceutical contract support organization's Standard Operating Procedures, and such activities were recorded in the animal room records. Animals were housed and maintained according to the AAALAC International Guide for the Care and Use of Laboratory Animals, CCAC Guidelines for Care and Use of Experimental Animals and pharmaceutical contract support organization's Standard Operating Procedures.

Although the aforementioned described embodiments of the invention constitute the preferred embodiments, it should be understood that modifications can be made thereto without departing from the scope of the invention as set forth in the appended claims.

What we claim is:

1. A non-detergent cleaning composition comprising: effective amounts of at least two organic acids; sodium chloride; and a carrier/diluent having the at least two organic acids and sodium chloride mixed thereinto, the amounts of the at least two organic acids and sodium chloride being sufficient to result in the cleaning composition having commercial acceptable cleaning properties for surface/substrate, wherein the cleaning composition is surfactant free and solvent free, and the carrier/diluent is on average 95.0% deionized water, and wherein the at least two organic acids comprise on average about 1.5% citric acid, and about 2.6% lactic acid.

2. The cleaning composition according to claim 1, wherein the composition includes from about zero point zero eight (0.08%) to about one point six (1.6%) by weight of sodium chloride.

3. The cleaning composition according to claim 1, wherein the composition comprises from about zero pint zero five percent (0.05%) to about ten percent (10%) by weight of the at least two organic acids.

4. The cleaning composition according to claim 1, wherein the at least two organic acids are selected from the group consisting of carboxylic acid, dicarboxylic acid, tricarboxylic acid and alpha hydroxy acid.

5. The cleaning composition according to claim 4, wherein the tricarboxylic acid is an anhydrous form of citric acid in combination with the carboxylic acid.

6. The cleaning composition according to claim 5, wherein the alpha hydroxy acid is lactic acid.

7. The cleaning composition according to claim 1, wherein the composition in a concentrate form comprises about two point eight percent (2.8%) by weight of citric acid; about four point nine six percent (4.96%) by weight of lactic acid; mixed into ninety point nine five nine percent (90.959%) by weight of carrier/diluent with one point two eight percent (1.28%) weight of sodium chloride.

8. The cleaning composition according to claim 1, wherein the composition in a ready-to-use form comprises about zero point one seven six percent (0.176%) by weight of citric acid; about zero point three one one percent (0.311%) by weight of lactic acid; mixed into ninety nine point four three percent (99.43%) by weight of diluent with zero point zero eight zero percent (0.080%) weight of sodium chloride.

9. The cleaning composition according to claim 7, wherein the composition includes a natural green dye.

10. The cleaning composition according to claim 1, wherein the cleaning composition has a pH in the range of about 1.0 to about 2.5.

11. The cleaning composition according to claim 1, wherein the cleaning composition has a pH in the range of 1.5-2.5.

12. The cleaning composition according to claim 1, wherein the cleaning composition has a pH of one point five 1.5 to two point zero 2.0, and five percent (5%) to ten percent (10%) weight of the at least two organic acids.

13. The cleaning composition according to claim 1, wherein the composition is a non-skin irritant.

14. The cleaning composition according to claim 1, wherein the composition is non-corrosive to eyes or ocular membrane thereof.

15. The cleaning composition according to claim 1, wherein the composition further comprises a gelling agent for contacting a vertical or horizontal surface/substrate.

16. A process for removal of soil and microorganisms from a surface/substrate, the process comprising the steps of:

(i) applying a disposable article to a target site of a surface/substrate in at least one direction;

(ii) applying a dry cloth to the surface/substrate thereafter; and (iii) wherein the disposable article is imbibed with the cleaning composition of claim 1.

17. A process for sequestering of soil and microorganisms from a surface/substrate, the process comprising the steps of:

(i) contacting the surface/substrate with a solution comprising the cleaning composition of claim 1;

(ii) applying a dry cloth to the surface/substrate; and (iii) removing the imbibed cloth from the surface/substrate.

18. A disposable article comprising:

(a) a base sheet; and (b) an aqueous solution incorporated into the base sheet, wherein the aqueous solution includes the composition of claim 1.

19. A process for sequestering and removal of soil and microorganisms from a surface/substrate comprising the steps of: applying the cleaning composition of claim 1 to a target site of a surface/substrate in at least one direction; applying a dry cloth to the surface/substrate thereafter; and removing the cloth, wherein the cloth is imbibed with the cleaning composition.

20. The process according to claim 19, wherein the imbibed cloth is reusable.

21. The process according to claim 20, wherein the imbibed cloth is machine or hand washed and dried.

22. The process according to claim 19, wherein the solution is sprayed onto the target site.

23. The process according to claim 19, wherein the solution is in a liquid gel form for applying to a vertical or horizontal surface/substrate.

24. The cleaning solution according to claim 8, wherein the composition includes a natural green dye.

* * * * *